United States Patent [19]

Goldberg

[11] Patent Number: 4,573,602

[45] Date of Patent: Mar. 4, 1986

[54] MOLDED SAFETY CLOSURE DEVICE AND METHOD FOR MAKING SAME

[76] Inventor: James R. Goldberg, 315 Grandview Ave., Novato, Calif. 94947

[21] Appl. No.: 629,369

[22] Filed: Jul. 10, 1984

[51] Int. Cl.[4] ..... B65D 41/48

[52] U.S. Cl. ..... 215/256; 215/306; 215/320

[58] Field of Search ..... 215/256, 258, 306, 320, 215/354

[56] References Cited

U.S. PATENT DOCUMENTS

| | | | |
|---|---|---|---|
| 773,345 | 10/1904 | Scheidt | 215/306 |
| 1,265,263 | 5/1918 | Sharpe | 215/306 |
| 3,235,117 | 2/1966 | Mason, Jr. | 215/306 X |
| 3,599,821 | 8/1971 | Eggert et al. | 215/320 X |
| 3,904,062 | 9/1975 | Grussen | 215/25.2 |
| 3,946,891 | 3/1976 | Picoy et al. | 215/320 X |
| 3,994,409 | 11/1976 | Nightengale | 215/306 |
| 3,995,762 | 12/1976 | Pfefferkorn et al. | 215/320 X |
| 4,429,799 | 2/1984 | Zaltsman | 215/306 X |
| 4,474,302 | 10/1984 | Goldberg et al. | 215/256 |

*Primary Examiner*—Donald F. Norton
*Attorney, Agent, or Firm*—Fitch, Even, Tabin & Flannery

[57] ABSTRACT

A molded safety closure device and a method for making same are described. A cylindrical closure element adapted to close the mouth of a bottle or the like by frictional engagement with the interior facing surface of the mouth is supported on the bottle by a cylindrical retainer collar extending substantially coaxial with the closure element. The retainer collar is connected to the closure element by intercoupling means comprising a tabbed tear strip and a tether strip. The tear strip and the tether strip are integrally formed in a helical configuration extending one or more turns from the closure element to the collar. The tether strip and tear strip are joined by a pair of frangible webs of a preselected thickness which permit the tear strip to be manually removed. The collar and intercoupling section are molded as a unitary structure. The closure element is molded as a separate unitary structure and is secured mechanically to the intercoupling means by snap-fit about the periphery of one end of the closure element.

4 Claims, 4 Drawing Figures

MOLDED SAFETY CLOSURE DEVICE AND METHOD FOR MAKING SAME

This invention relates generally to closure devices and, more specifically, to a safety closure device for use on bottles containing pressurized beverages such as champagne or sparkling wines.

The drinking of champagne or sparkling wine is usually associated with happiness and frivolity. Unfortunately the happiness and frivolity has all too often ended in tragedy because of injuries caused by flying corks. Because of pressure inside a bottle of champagne or sparkling wine, particularly if the wine has been shaken or is warmer than recommended, a cork can be propelled from the bottle at a velocity of well over 120 kph. As a consequence, unattentive individuals opening the bottle, or persons standing nearby, can be seriously injured.

The problem of premature or inadvertent explosive release of champagne corks is axacerbated by the fact that many lower priced champagnes and sparkling wines are closed by molded plastic corks. Plastic corks possess an even greater tendency than natural corks to become dislodged as a result of internal pressure in the bottle. In addition, the slipperiness of plastic is sometimes increased when the cork is molded because of a residue of the release agents often used to facilitate removal of a hot plastic cork from the mold in which it is made. Wetness on the glass surface of the bottle as a result of condensation or seepage of the contents can also reduce friction between the surface of the glass and the surface of the plastic cork.

An improved closure device for a bottle or the like which is particularly well suited for use in connection with champagne and sparkling wines is shown and described in copending U.S. application Ser. No. 548,313. The device shown and described therein employs a tabbed tear strip and a tether strip that are integrally formed in an outer retaining collar which fits over the neck of the bottle. When the tear strip is torn away, a helical tether strip remains interconnecting the plug or cork and the retainer collar. The cork or plug may thus be easily released from the bottle but is restrained from flying free.

The foregoing device provides a significant improvement in closures for bottles and other containers containing pressurized liquids such as champagne or sparkling wines. The need for additional restraining devices such as wire baskets, shrink wraps, or the like is eliminated. Moreover, it is unnecessary for the person opening the bottle to manually restrain the champagne cork as it is being removed from the bottle.

The improved closure device of the aforementioned copending application has a cap portion, a cylindrical plug portion extending therefrom, and a cylindrical collar extending substantially coextensively and coaxially with the plug portion. The collar and the plug are spaced from each other to provide an annular cavity for receiving the open end of the container to be closed. Thus, with the plastic closure mounted in place, the plug extends into the opening in the container and the collar surrounds the outside of the container at the opening to retain the plug in position.

The molding of a plastic closure device is typically carried out in an injection molding machine. Such machines usually employ a plurality of die plates and, in appropriate cases, a movable core. The die plates and core move once the device is molded to separate and enable removal of the molded device from the molding machine. Where, as is the case with the improved plastic closure device which is the subject matter of this invention, there are two portions extending substantially coextensively and coaxially with each other, the molding procedure and die may be extraordinarily complex. With a cylindrical device, a collapsible mold core may typically be provided making removal of the molded part after molding relatively simple. However, in the present case, a collapsible core is not practical due to the presence of the plug portion of the closure device coextensive and coaxial with the surrounding cylindrical collar. This problem is exacerbated where the collar is provided with an annular recess for mating with a retaining ring on the bottle or other container because of the difficulty the needed core shape presents in withdrawing the core from the annular cavity between the plug portion and the cylindrical collar.

It is an object of the present invention to provide an improved safety closure device for use on bottles containing pressurized beverages such as champagne or sparkling wines.

Another object of the invention is to provide an improved safety closure device and an improved method for making same which facilitates manufacture of the device.

It is another object of the invention to provide an improved safety closure device and an improved method for making same, wherein the device includes a cylindrical plug or closure element extending coaxially with an outer cylindrical collar, the latter serving to retain the closure device on the container.

Other objects of the invention will become apparent to those skilled in the art from the following description, taken in connection with the accompanying drawings wherein.

Very generally, the safety closure device of the invention comprises a cylindrical closure element adapted to close the mouth of a bottle or the like by frictional engagement with the interior facing surface of the mouth of the container. A cylindrical retainer collar is provided and an intercoupling means connect the collar to the closure element with the closure element and the collar extending substantially coaxial with each other. The intercoupling section comprises a tabbed tear strip and a tether strip. The tear strip and the tether strip are integrally formed in a helical configuration extending one or more turns from the closure element to the collar. The tether strip and the tear strip are joined by a pair of frangible webs of a preselected thickness to permit the tear strip to be manually removed. The collar and the intercoupling means are comprised of a unitary molded structure. The closure element is comprised of a separate unitary molded structure and is mechanically secured to the intercoupling means about the periphery of one end of the closure element by means of an annular rib mating in a corresponding annular recess.

Figure 1:
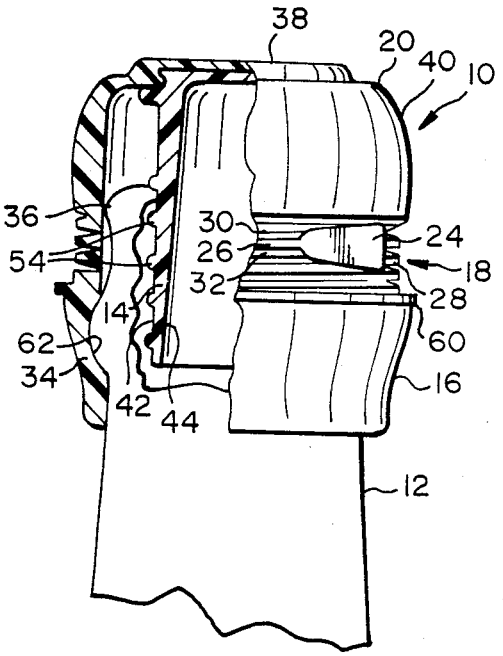
FIG. 1 is a partially sectional side view of a safety closure device constructed in accordance with the present invention.
Figure 2:
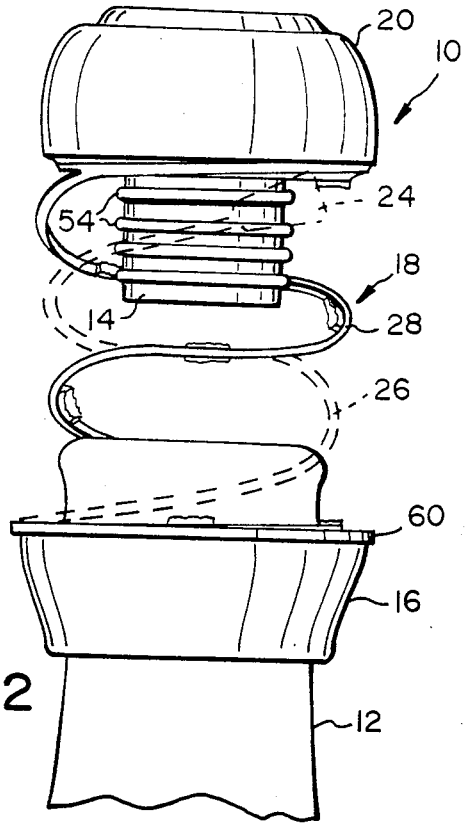
FIG. 2 is a partially sectional side view of the device of FIG. 1 illustrating partial removal of a tabbed tear strip.

A closure device of the type to which the present invention relates is illustrated in FIGS. 1 and 2. The safety closure device 10 is shown mounted on the neck of a bottle 12 designed to hold pressurized liquids such as champagne or other sparkling wines. The device 10 includes a cork or plug 14 and a retainer collar 16 both connected to a cap portion 20.

The plug 14 is adapted to close the mouth of the bottle by frictional engagement with the interior facing surface of the mouth. An intercoupling section 18 is provided in the collar 16 comprised of a tabbed 24 tear strip 26 and a tether strip 28 that are formed integrally in the intercoupling section as parallel helices extending one or more turns from the cap 20 to the collar 16. The tether strip 28 and the tear strip 26 are interconnected by a pair of grooved frangible webbed sections 30 and 32. The thickness and configuration of the pair of grooved frangible webs are preselected to be less than the thickness of the tether and tear strips. The tear strip 26 also contains the integral pull tab portion 24 which provides and easy and convenient means for grasping the tear strip 26 prior to its removal as described below.

When the pull tab portion 24 of the tear strip 26 is grasped and pulled by one wishing to open a bottle of sparkling wine, the tear strip 26 separates from tether strip 28 because of a tearing of the frangible web sections 30 and 32 along the path of the grooves between the tether and tear strips. When the helical tear strip 26 is removed, the helical tether strip 28 remains to interconnect element 14 and collar 16 thus enabling element 14 to be released from the bottle 12 without flying free.

The bottle 12 in FIGS. 1 and 2 is typical of bottles used to contain champagne and sparkling wines. Such bottles often have elongated, tapered, cylindrical necks containing a circumferential bulge or ridge 34 (known to the trade as a "finishing or bead ring") just below a lip 36 at the top of the bottle. The circumferential ridge 34 protrudes from the side of the bottle with sufficient radius to provide a means for restraining or impeding objects or devices, fastened above or below it, from moving up or down the neck of the bottle. In the past, such objects and devices have included, for example, woven wire baskets used to restrain plugs or corks. In the present invention, the circumferential ridge 34 is used to restrain the retainer collar 16.

The closure device 10 is preferably formed of a molded unitary piece of a suitable resilient substance. While polymerized plastic is a preferable resilient substance, other resilient substances are suitable as long as they are weak in shear when thin but strong in tension when thick. As used herein, "weak in shear when thin" means a substance that is manually tearable when used at the preselected thickness of the thin frangible webs connecting the tear and tether strips. "Strong in tension when thick" means that, at the thickness of the tether strip, the substance is strong enough to withstand longitudinal strain caused by sudden release of the cork from the bottle.

For purposes of this invention, a suitable resilient substance will be moldable. A suitable resilient substance will also have sufficient resiliency to allow the tapered retainer collar 16 to stretch but not break as it is inserted over the neck of the bottle, including the circumferential ridge 34. Following the expansion necessary to allow the tapered retainer collar 16 to pass over the circumferential ridge 34, a suitable material will still have sufficient resiliency to allow the collar to assume a shape that conforms generally to the contour of the outside of the bottle.

The cap 20 is of generally cup-like shape and is comprised of a circular disk-like top portion 38 integrally molded with a hollow cylindrical side portion 40. The diameter of the cap's circular top portion 38 is greater than the diameter of top of the bottle neck. The inner circumference of the cap's hollow cylindrical side portion is greater than the outer circumference of the lip 36 at the top of bottle.

Pursuant to the present invention, the plug 14 is molded as a separate unit from the remainder of the device, namely, the collar 16 and intercoupling means 18. The device is then assembled as explained below, prior to mounting on the bottle being closed. The top of the plug 14 is connected to the inside of the circular disk-like top portion 38 on the cap 20 as explained in detail below. The plug 14 is preferably hollow having an outer cylindrical wall surface 42 and an inner cylindrical wall surface 44. The cylindrical plug 14 has an outer diameter very slightly smaller than the diameters of the opening at the top of the bottle and the upper inner portions of the bottle neck. This allows the plug to fit tightly down into the neck of the bottle.

About half-way down the length of the plug 14, a series of parallel annular ridges 54 protrude slightly from the plug's outer wall surface 42. The width and height of the annular ridges are approximately equal. The annular ridges extend down the outer wall 42 of the plug to a point approximately in line with the bottle's circumferential ridge 34 when the device 10 is in place in a bottle 12. When in place, the circumferential wall of the plug 14 supports the annular ridges against the inner wall of the bottle neck. As a result, the annular ridges grasp against the side of the bottle helping to seal its contents.

The intercoupling section 18 joins the cap 20 and the retainer collar 16. The intercoupling section is comprised of a tabbed 24 tear strip 26 and a tether strip 28. The tab 24 on the tear strip 26 may be suitably roughened, not shown, to help prevent the tab from slipping when grasped by a person wishing to remove the tear strip from the closure device.

The tear strip 26 and the tether strip 28 are formed integrally in parallel helices extending one or more turns from the cap 20 to the collar 16. The tear and tether strips do not begin at the same region, nor do they end in the same region on the collar. They preferably begin or end separated from one another by an arc of approximately 60°. Such an arc permits complete separation of the tear strip from the closure device.

The tear and tether strips extend one or more turns from the cap 20 to the collar 16. Any number of turns can be used in the present device as long as they allow the tether strip to permit removal of the plug 14 while still adequately restraining the plug 14 from flying free. Between two and four turns is preferred.

The tether strip 28 and the tear strip 26 are interconnected by a pair of grooved frangible webs 30 and 32. The grooves between the tether strip and the tear strip, formed by the frangible webs, extend from the cap 20 to the collar 16. The webs may be continuous, or may be broken by a series of openings, not shown, which facilitate removal of the tear strip. The segments of the webs are selected in size and number to provide sufficient strength to maintain a cohesive structure until removal of the tear strip. The tear strip 26 is removable by manually causing the webs to tear. Following removal of the tear strip 26, as shown in FIG. 2, the tether strip 28 remains attached to the cap 20 and the collar 16. This may be accomplished by means of a merging brought about by a gradual diminution of the depth of the groove separating the cap or collar material from the initial or final tether turns.

In addition to providing the means for connecting the cap 20 to the retainer collar 16, the intercoupling section 18 creates an integral tamperproof safety seal between the cap 20 and the collar 16 because it unmistakably indicates by dismemberment if the product has been prematurely opened or tampered with anywhere between the bottler's facilities and the end user's location.

The retainer collar 16 is comprised of a hollow tapered cylinder that fits around the top outside portion of the bottle neck. The cylinder is tapered both in shape and in thickness. The tapered shape of the retainer collar 16 generally mirrors the contour of the taper on the champagne or sparkling wine bottle 12. At the lower end of the intercoupling section 18, a small circumferential ridge 60 is provided that protrudes from the outer surface of the collar 16. Just below ridge 60, on the inner surface of the collar wall, the collar contains a circumferential groove or annular recess 62. The shape and size of the recess 62 generally mirrors and approximates the shape and size of circumferential ridge 34 on the outer surface of the champagne or sparkling wine bottle. When the tethered safety closure device 10 is installed on a champagne or sparkling wine bottle, the collar's annular recess 62 fits around the circumferential ridge 34 on the neck of the bottle, holding the collar in place. Security of the collar on the bottle neck is assured by providing sufficient thickness in the wall of the collar below groove 62 to prevent circumferential expansion and consequent upward movement of the collar 16 as a result of pressure in the bottle.

Because of the design of the tethered safety closure device and the material used to construct it, the unitary tethered safety closure device of the present invention can easily be inserted on bottles containing champagne or sparkling wine. The thickness at the bottom of the retaining collar is selected to facilitate placing the device on the wine bottle. The resiliency of the material used to make the tethered safety closure device allows it to expand and contract as necessary to fit securely in and around the neck of the bottle. This resiliency can be increased with heat if the properties of the material so warrant.

Figure 3:
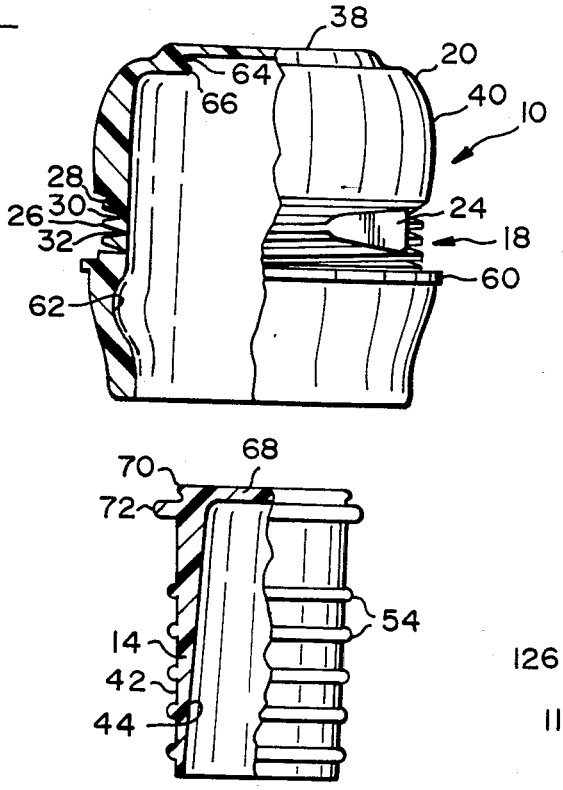
FIG. 3 is an exploded view of the device of FIG. 1 illustrating the manufacture of the device in two separate parts.

As may been seen in FIG. 3, the closure element or plug 14 is molded as a unitary separate device from the combination of the collar 16 and intercoupling means 18. More specifically, the cap-like portion 20 which extends over the lip 36 of the container 12 and down a short distance on either side is formed integrally with the collar 16 and, as such, constitutes a continuation of the intercoupling means 18. The interior surface of the cap-like portion 20 is formed with an annular recess 64, leaving a lip 66 of the molded material, which is resilient, extending about the periphery of the annular recess.

The closure element 14 is closed at one end by a wall 68 and is provided with an annular protuberence or rib 70 adapted to fit in the recess 64 after snapping past the resilient lip 66. A flange 72 molded integrally with the closure element 14 abutts the interior surface of the cup-like portion 20 below the ridge 66 to stabilize the closure element. Further stability is imparted by the upper surface of the wall 68 abutting the inner surface of the disk-like portion 38. Thus, the closure device of the invention may be snapped together readily and is well adapted to automated assembly. Further stability may be provided, if desired, by welding the two pieces together where they abutt.

Figure 4:
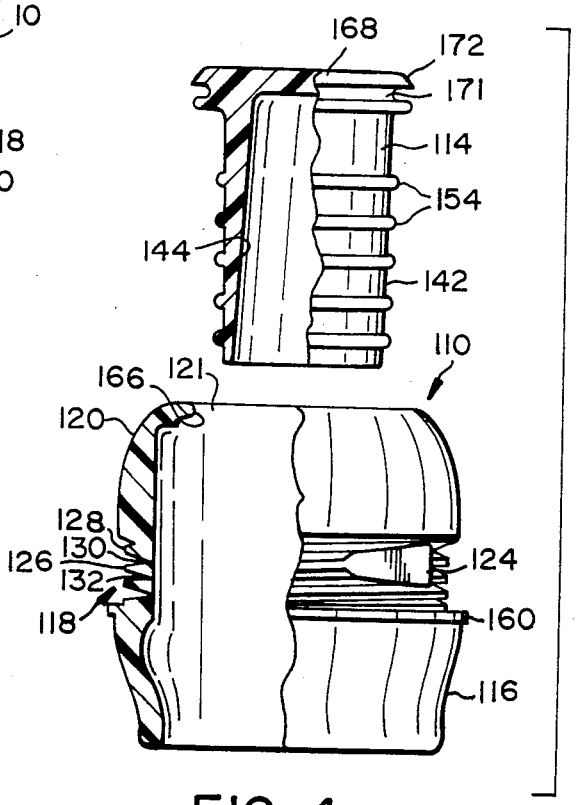
FIG. 4 is an exploded view similar to FIG. 3 illustrating an alternate embodiment of the invention.

Referring to FIG. 4, an alternative embodiment of the invention is shown. In the embodiment of FIG. 4, elements corresponding to those of FIGS. 1–3 have been given identical reference numbers, preceeded by the numeral 1. The cup-like cap portion 120 has a circular opening 121 therein. An annular rib 166 extends inwardly at the periphery of the opening 121. The closure element 114 is provided with a corresponding annular recess 171 around the periphery near one end thereof. A flange 172 projects outwardly from the circular cap closing the end of the closure element. The closure element is inserted into the opening in the cup-like cap and pushed inwardly until the annular ridge snaps into the annular recess. The flange stabilizes the closure element in the cup-like cap portion. Once again, the nature of the two-piece construction with the snap fit is readily adapatable to automated assembly. Further stability may be provided by welding in the regions of contact between the closure element and the cup-like cap portion.

The device and method of the invention make it possible to readily manufacture the closure device of the invention by manufacturing the device in two separate molding operations with subsequent automated assembly. Stability is provided between the two separately molded parts and the integrity of the assembly may be enhanced by further welding operation if desired. Once assembled, the device may be installed in a single step by standard bottling apparatus.

Various modifications of the invention in addition to those shown and described herein will become apparent to those skilled in the art from the foregoing description and accompanying drawings. Such modifications are intended to fall within the scope of the appended claims.

What is claimed is:

1. A molded safety closure device comprising, a cylindrical closure element adapted to close the mouth of a bottle or the like by frictional engagement with the interior facing surface of the mouth, a cylindrical retainer collar, and an intercoupling means connecting said collar to said closure element with said closure element and said collar extending substantially coaxially with each other, said intercoupling means comprising a unitary molded structure having a cup-like portion that is shaped to extend over the lip of the container, said intercoupling means further comprising a tether strip, said tether strip being integrally formed extending one or more turns from said cup-like portion to said collar, said tear strip being joined by a pair of frangible webs of a preselected thickness to permit said tether strip to be manually separated from the remainder of said intercoupling means, said closure element comprising a separate unitary molded structure and being secured to said intercoupling means about the periphery of one end of said closure element, said closure element and said cup-like portion having an annular weld securing said closure element to said cup-like portion of said intercoupling means about the periphery of one end of said closure element.

2. A closure device according to claim 1 wherein said cup-like portion of said intercoupling means includes a circular recess therein for receiving said one end of said closure element.

3. A closure device according to claim 1 wherein said cup-like portion of said intercoupling means includes a circular opening therein for receiving said one end of said closure element.

4. A closure device according to claim 1 wherein said closure element is closed at one end by means of a circular wall.

* * * * *